United States Patent [19]

Trindle et al.

[11] 4,193,506

[45] Mar. 18, 1980

[54] DISPOSABLE INFANT NURSER

[75] Inventors: Dean D. Trindle; John S. Amneus, both of Cincinnati, Ohio

[73] Assignee: Procter & Gamble Company, Cincinnati, Ohio

[21] Appl. No.: 906,122

[22] Filed: May 15, 1978

[51] Int. Cl.[2] ..... A61J 9/08

[52] U.S. Cl. ..... 215/11 C; 426/117

[58] Field of Search ..... 215/1, 11 R, 11 C, 11 E; 150/0.5, 1; 426/117

[56] References Cited

U.S. PATENT DOCUMENTS

| | | | |
|---|---|---|---|
| 1,985 | 2/1841 | Windship | 215/11 R |
| 2,412,544 | 12/1946 | Waters | 150/0.5 |
| 2,446,451 | 8/1948 | Allen | 215/11 R |
| 2,518,651 | 8/1950 | Weiss | 150/1 |
| 2,519,986 | 8/1950 | Trout | 215/11 R |
| 2,628,909 | 2/1953 | Horan | 215/11 R |
| 2,687,158 | 8/1954 | Owen | 150/1 |
| 2,956,702 | 10/1960 | Ransom | 215/11 R |
| 3,097,757 | 7/1963 | Searer | 215/11 R |
| 3,117,874 | 1/1964 | Horan | 215/11 R |
| 3,289,874 | 12/1966 | Dailey et al. | 215/11 C |
| 3,334,764 | 8/1967 | Fouser | 215/11 R |

FOREIGN PATENT DOCUMENTS

| | | | |
|---|---|---|---|
| 789032 | 3/1973 | Belgium . | |
| 678359 | 1/1964 | Canada | 215/11 R |
| 33421 | 10/1885 | Fed. Rep. of Germany | 215/11 R |
| 1347668 | 2/1974 | United Kingdom . | |

*Primary Examiner*—Donald F. Norton

*Attorney, Agent, or Firm*—Frost & Jacobs

[57] ABSTRACT

A disposable, sterile infant nurser comprising a resilient, liquid-impermeable container bag the peripheral edge of which has a corolla-like configuration; a relatively rigid, upstanding circular neck secured to an opening in the bag, the neck including means for holding the nurser projecting radially outwardly adjacent the base of the neck; an apertured nipple releasably secured to the neck; and a removable cover overlying the nipple and holding it in retracted position substantially within the confines of the neck. A measured amount of dry infant formula is provided within the container bag adjacent the perimeter of the bag. The nurser is completely self-contained, lightweight, compact, adapted for home or hospital use, and can be packaged by vertical stacking in a sterile container.

22 Claims, 9 Drawing Figures

DISPOSABLE INFANT NURSER

BACKGROUND OF THE INVENTION (1) Field of the Invention

This invention relates to a sterile, disposable infant nurser containing a measured amount of powdered infant formula, to which water is added for a single feeding. The nurser is completely self-contained, lightweight, compact and convenient, and a plurality of individual nursers can be packaged by vertical stacking in a sterile container with a replaceable lid for resealing. The capacities of individual nursers can be varied, e.g. from about 2 to about 10 ounces.

(2) Description of the Prior Art

U.S. Pat. No. 2,446,451 to A. M. Allen discloses an infant nursing unit having a pliable disposable container bag and a reusable end closure comprising a rigid collar and a nipple attached thereto. The collar includes concentric neck and retaining ring portions, the neck portion entering an opening in the bag and the retaining ring encircling the opening, whereby the open end of the pliable bag may be clamped and sealed.

While the disposable container bag of the Allen patent is flexible and follows the volume of liquid therein as the liquid is nursed from the container, thereby avoiding ingestion of air by the infant, it is evident that the unit is inconvenient to use by reason of its extreme limpness which makes it non-self-supporting and hence not self-feeding. Such limpness could actually cause suffocation. Moreover, sterilization of the end closure is required for each feeding, and measuring of formula is necessary for each feeding.

U.S. Pat. No. 3,289,874 to D. E. Dailey et al discloses a disposable infant nursing container comprising a plastic container body, a nipple-receiving opening therein, a nipple in the opening, and a removable cover over the nipple which holds it in retracted position prior to use. The upper portion of the container body is a generally spherical section of plastic material which may be thermoformed, vacuum molded, cast or blow molded. Concentric ribs are formed therein. The lower portion is of similar configuration but is of sufficient resilience to collapse inwardly as liquid is withdrawn during feeding.

For hospital use, the Dailey container may be provided with a measured amount of powdered infant formula, so that it is self-contained. However, the nipple assembly is not removable, so that water or formula can be added only by inserting a hollow needle through a cross-cut opening in the nipple. This is not well suited to home use.

Other U.S. Pat. Nos. showing the background of the art in this field include 2,987,208; 2,956,702; 2,112,837; 3,294,268; 3,319,838 and 3,334,764. In general, these relate to disposable containers having reusable nipple assemblies.

It is evident from the above summary of the prior art that there has been no suggestion of a sterile, disposable, completely self-contained infant nurser adapted for home or hospital use which can be easily and conveniently filled with water, which is lightweight, vertically and horizontally compact, soft and flexible for easy handling, safe, non-breakable, and non-rollable on almost any surface.

SUMMARY OF THE INVENTION

It is a principal object of the invention to provide an infant nurser having the above combination of properties.

The above object of the invention is achieved in a disposable infant nurser of the type comprising a nipple assembly, a cover overlying the assembly, a pliable container bag having a nipple receiving orifice, and means for securing the nipple assembly to the container bag. The novel container bag of this invention is formed of two superposed sheets of resilient, liquid-impermeable plastic material secured together along their mating peripheral edges, the edges having a corolla-like configuration containing from 3 to 16 curvilinear, alternating inward and outward convolutions.

The present invention provides a disposable, sterile infant nurser comprising a pliable container bag formed of first and second superposed sheets of resilient, liquid-impermeable film material secured together along their mating peripheral edges, said edges having a corolla-like configuration; an orifice positioned centrally of the first sheet; a relatively rigid, upstanding circular neck extending outwardly from the orifice and secured to the first sheet circumferentially of the orifice, the neck including means for holding the nurser projecting radially outwardly adjacent the base of the neck; apertured nipple means releasably secured to the neck; and a removable cover of resilient material overlying the nipple means and holding it in retracted position substantially within the confines of the neck. A measured amount of dry, particulate infant formula is distributed within the container bag between the peripheral edges thereof and the neck, thereby providing the most compact possible nursing unit having a total height ranging from about $\frac{1}{4}$ to about 1 inch.

Preferably the peripheral edges are heat sealed to form a resilient margin outlining the corolla-like configuration, in such manner that the edges bias away from the nipple end, which bias persists when the bag is filled with liquid, as described in detail hereinafter.

The means projecting radially outwardly from the base of the neck is preferably an annular, substantially flat ring integral with the neck having an outside diameter about $\frac{1}{8}$ to about $\frac{3}{4}$ inch greater than that of the removable cover. This annular ring provides a convenient means for holding the nurser when removing the nipple, filling the container bag with liquid and replacing the nipple.

The floral corolla-like configuration, which preferably comprises from 6 to 10 curvilinear, alternating inward and outward convolutions in the nature of scallops, rounded points or "petals", causes the container bag to approximate two euclidean surfaces which together form a series of generally pyramidal shapes when filled with liquid. When the outer margin of the container bag is circular, these generally pyramidal shapes are radially disposed with the apices directed outwardly, it being understood that all edges are rounded by reason of the resilient plastic material and the liquid contained therein.

The container bag is preferably formed of a single layer or laminate of polypropylene, polyethylene, polyester, or the like, each of the first and second sheets being about $\frac{1}{2}$ to about 3 mils in thickness. The neck and means projecting radially outwardly therefrom are also preferably made from the same material, as is the removable cover.

Since the nipple is used only once, and is sterilized as an incident of production and maintained under aseptic conditions during assembly and packaging, it may be made of relatively inexpensive elastomeric material, and may have variable sizes, hole openings and degree of flexibility.

BRIEF DESCRIPTION OF THE DRAWINGS

Reference is made to the accompanying drawings wherein.

DESCRIPTION OF THE PREFERRED EMBODIMENTS

Figure 1:
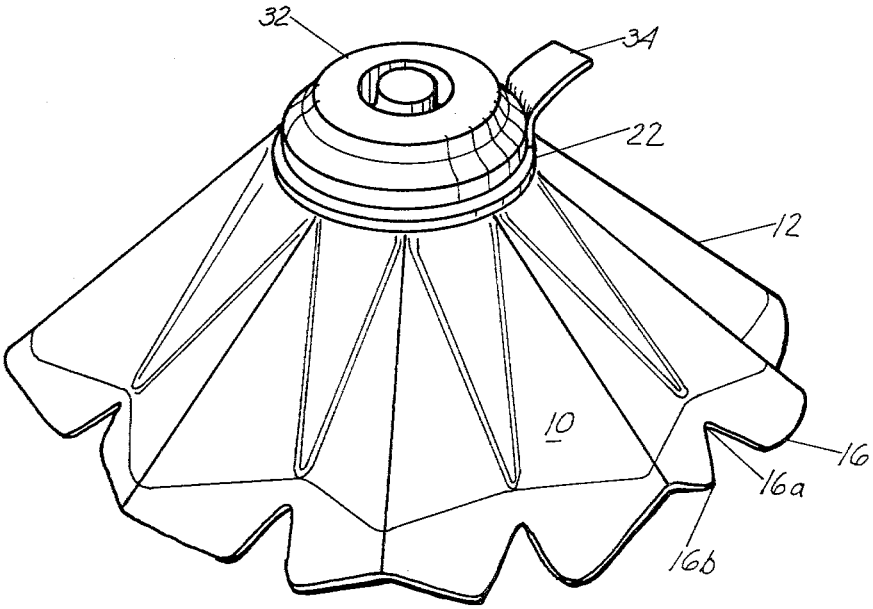
FIG. 1 is a perspective view of an infant nurser filled with liquid, embodying the present invention.
Figure 2:
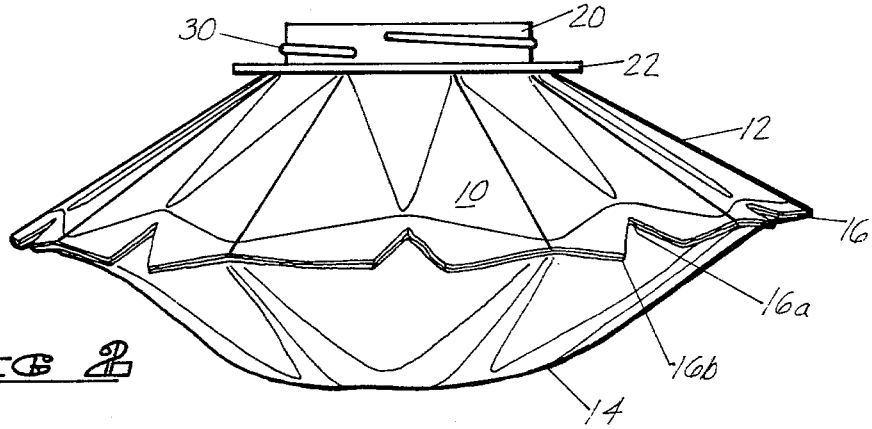
FIG. 2 is a side plan view of a container bag of the present invention filled with liquid.

Referring to FIGS. 1 and 2 a pliable container bag is indicated generally at 10, formed of superposed first and second sheets 12 and 14, respectively, and secured together along their mating peripheral edges as indicated at 16. The sheets 12 and 14 are of resilient, liquid-impermeable film-like material each having a thickness of about ½ to about 3 mils. Preferably each sheet will be a single layer or laminate of a polymer such as polypropylene, polyethylene, polyester, and the like.

Figure 5:
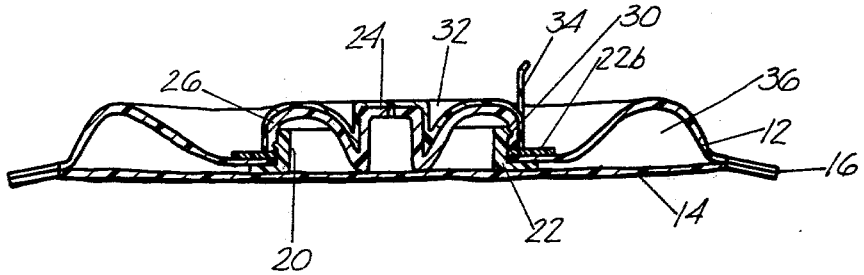
FIG. 5 is a vertical sectional view of a further embodiment of an infant nurser according to the invention prior to filling with liquid.

Preferably the peripheral edges of sheets 12 and 14 are secured by heat sealing, and this is effected in such manner as to provide a marginal area defining a floral corolla-like configuration and to bias the heat sealed margin, downwardly as viewed in FIG. 5. The bias persists when the container bag is filled with liquid, as shown in FIG. 2. This is done by positioning the superposed sheets in the biased position prior to heat sealing on a mandrel having downwardly sloping edges underlying the peripheries of the sheets, thus causing the sheet edges to be displaced slightly relative to one another. Heat sealing in this position secures this displacement bias.

The biasing of the heat sealed margin away from the nipple end of the nurser as well as the geometry of the bag and the material from which it is made minimize the possibility that the container bag will collapse downwardly as it is emptied, thus avoiding risk of suffocation of an infant.

Figure 4:
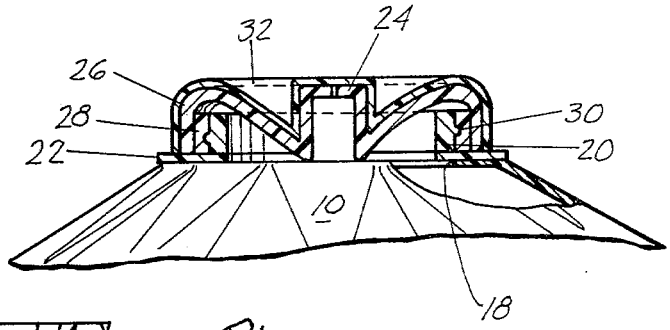
FIG. 4 is a fragmentary sectional view of the upper portion of an embodiment of a nurser in accordance with the invention.

An orifice or opening is provided centrally of sheet 12, as shown at 18 in FIGS. 4–7. A relatively rigid upstanding circular neck 20 is provided extending outwardly from the orifice 18 and is secured to sheet 12 circumferentially of the orifice. In the embodiment of FIGS. 1, 2 and 4, the neck 20 includes means 22 for holding the nurser projecting radially outwardly adjacent the base of the neck, as shown clearly in FIG. 2. In this embodiment the means 22 comprises an annular substantially flat ring integral with the neck 20 and overlying the orifice 18 in sheet 12. Preferably the neck 20 and ring 22 are formed as by molding from a polymeric material which lends itself to fastening to sheets 12 and 14, and in this embodiment sheet 12 is secured to the underside of ring 22 as by heat sealing to form a liquid-impermeable seal around the orifice 18.

Referring to FIG. 4, nipple means is shown at 24. Such means is provided with an aperture in the top thereof in the usual manner for nursing, and the nipple means is provided further with an annular skirt-like portion 26. A separate sleeve 28 having internal threads which mate with and engage external threads 30 on the neck 20 (see FIG. 2) is shown in FIG. 4. This arrangement is advantageous where the nipple means may be formed of very soft and resilient material since the sleeve 28 may be somewhat more rigid to prevent accidental disengagement of the threaded surfaces.

Figure 6:
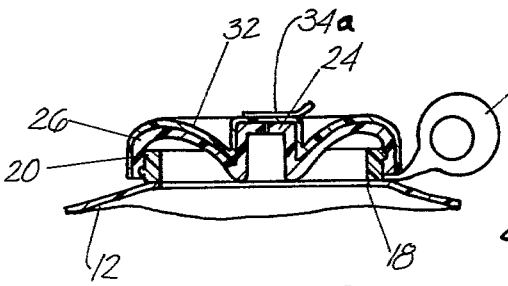
FIG. 6 is a fragmentary sectional view of another embodiment of the invention.

In the embodiments of FIGS. 5 and 6 the skirt-like portion 26 of nipple means 24 is internally threaded to mate with and engage threads 30 on neck 20, the nipple means thus being an integral structure. This is desirable where the nipple means is not of extreme resilience.

A removable cover of appropriate material is provided overlying the nipple means, as shown at 32 in FIGS. 1, 4, 5, 6 and 8. The cover 32 is formed as by molding or thermoforming to have a press fit over the nipple means when the latter is releasably secured to the neck 20 and is so configured as to hold the nipple means in retracted position substantially within the confines of the neck 20, thereby providing a compact structure having an overall height ranging from about ¼ to about 1 inch. A tab 34, **34*a* of generally rectangular configuration may be provided at any of a number of suitable locations which is secured to the cover 32 for convenience in removal of the cover, as shown in FIGS. 1, 5, 6 and 8**.

Figure 3:
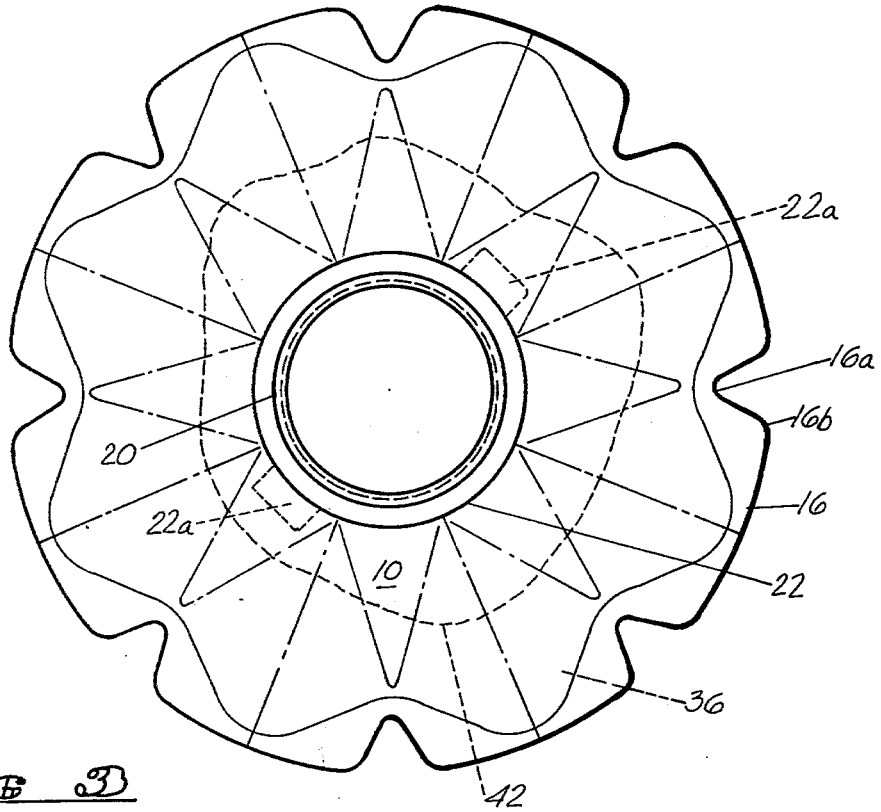
FIG. 3 is a top plan view of an infant nurser embodying the invention prior to filling with liquid.

Referring to FIG. 3, the corolla-like configuration of a circular container bag is shown, which in this embodiment comprises 8 curvilinear, alternating inward and outward convolutions **16*a* and 16*b***. The margins are curved in all instances both to void possible injury to an infant and to avoid stress concentrations on the container bag.

Figure 9:
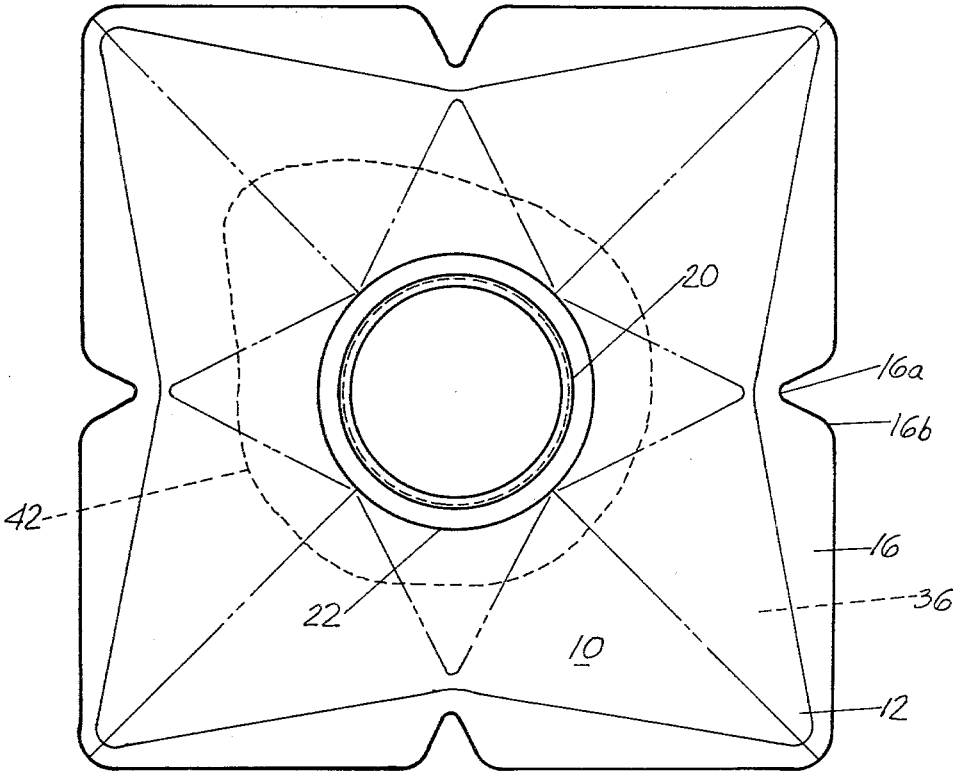
FIG. 9 is a top plan view, similar to FIG. 3, of a further embodiment of an infant nurser according to the invention.

It will be understood that the container bag may be circular, elliptical, oval, star-shaped, square, rectangular or the like, when viewed from the top, a generally square configuration being shown by way of example in FIG. 9. In all instances, however, a corolla-like configuration is provided comprising from 3 to 16 curvilinear, alternating inward and outward convolutions or "petals". From 6 to 10 such convolutions are preferred where the bag is circular or elliptical.

Reference is next made to FIGS. 3, 5 and 6 wherein further embodiments of the means for holding the nurser are shown. In FIG. 3 two or more appropriately disposed shoulders or ears are provided, two being shown at **22*a* in broken lines, by way of example, which may be integral wiwth the neck 20 and may be provided in addition to or in place of the annular ring 22 of the embodiment of FIGS. 1, 2 and 4. As best seen in FIG. 6, if the annular ring 22 does not extend radially outwardly beyond the cover 32, the container bag is secured as by heat sealing to the base of the neck 20 circumferentially of the orifice 18**.

In FIG. 5 the sheet 12 is positioned over ring 22 with a superposed ring **22*b*, and the assembled sandwich is heat sealed along a diameter not exceeding that of ring 22. Ring 22*b* has an outside diameter about $\frac{1}{8}$ to $\frac{3}{4}$ inch greater than that of the removable cover 32, and the outside diameter of ring 22*b* is shown to be greater than that of ring 22, but it will be understood that the outside diameter of ring 22*b* may be equal to or less than that of ring 22**.

FIG. 6 shows alternative means for holding the nurser comprising a table 22' of dimensions suitable to be grasped in the fingers of a user, the tab preferably being provided with a depression or an orifice for a firm finger grip. In this embodiment, the flat annular ring 22 of FIGS. 1, 2 and 4 is omitted, and the container bag is secured to the base of the neck 20 as by heat sealing circumferentially of the orifice 18.

Figure 7:
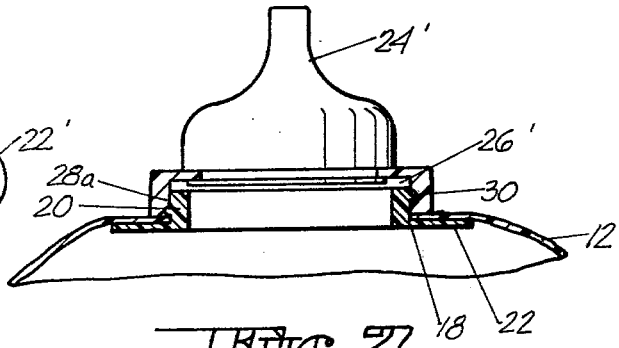
FIG. 7 is a fragmentary sectional view of another embodiment of the invention.

Referring next to FIG. 7, an alternative nipple means or assembly is illustrated. In this figure the nipple means is shown in its non-retracted, nursing position. The nipple 24' is provided at its lower edge with a radially outwardly extending flange 26' which is engaged beneath an internally threaded collar **28*a* which mates with the threads 30 on neck 20. In effect the nipple assembly of FIG. 7 is thus in two parts rather than integral, as in the previously described embodiments of FIGS. 5 and 6. FIG. 7 further shows sheet 12 overlying ring 22** and heat sealed thereto.

It will be understood that the various alternatives described above with respect to holding means 22, **22*a*, 22*b* and 22' may be used interchangeably with the various nipple means or assemblies shown in FIGS. 4–7. For example, the integral nipple means of FIGS. 5 and 6 is not restricted to use only with holding means 22*b* or 22'** shown therein.

Figure 8:
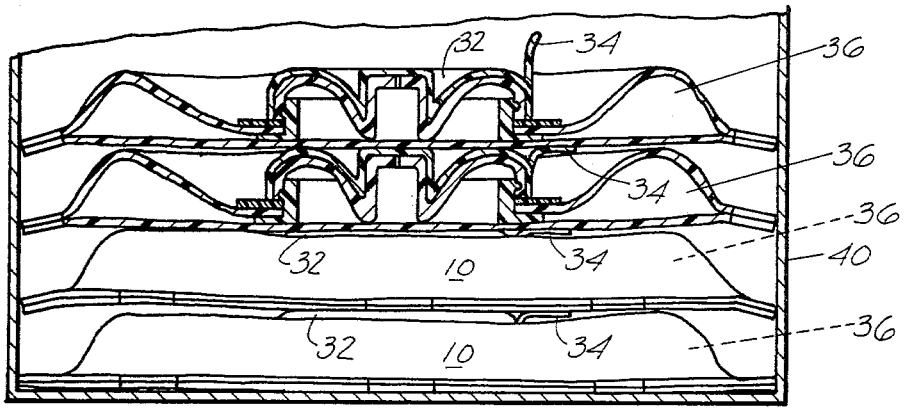
FIG. 8 is a diagrammatic side view, partially in section, illustrating the packaging of a plurality of nursers in a container.

FIG. 8 is a schematic illustration of the manner of packing a plurality of nursers of the present invention in a sterile container shown at 40. Since each nurser has a total height not exceeding about 1 inch, it will be evident that a relatively large number can be packaged in a container of convenient size. While the nursers are provided in a number of different volumetric capacities ranging from about 2 to about 10 fluid ounces, the peripheral dimensions do not differ markedly, so that it would be possible to package an assortment of different sizes in a single container. However, ordinarily a container would be packaged with nursers all having the same capacity, e.g., 4 ounces. It will be recognized that the nurser of this invention is lightweight, so that a relatively large number, when packaged, would be easy to carry, in comparison to the weight of canned liquid formula currently in widespread use.

As shown in FIG. 8, by causing the powdered formula indicated at 36 to occupy the annular volume around the neck 20, the stacking height is minimized and determined by the height of the cover 32, nipple 24 and neck 20 assembly.

As indicated previously FIG. 9 illustrates a container bag in accordance with the invention having a generally square configuration when viewed from the top. In this configuration the container bag may be considered to comprise 4 "petals" formed by curvilinear, alternating inward and outward convolutions **16*a*, 16*b***.

A measured amount of dry, particulate infant formula is introduced into each container bag prior to assembly of the nipple means and protective cover 32. The formula is indicated at 36 in FIGS. 3, 5, 8 and 9 and is preferably positioned in the area between the sealed edges 16 and the neck 20, the area generally occupied by the powdered formula being shown in dashed lines 42 in FIGS. 3 and 9. This contributes to the compact configuration of the nurser when packaged, as previously described. In addition, the central portion is free of powder, allowing the water to be introduced and mixed uniformly without displacing the powder into the atmosphere.

It will be understood that all materials used in production of the nurser are sterile or sterilized as an incident of manufacture, and the materials are maintained under aseptic conditions throughout assembly and packaging. Since the nipple means will be used only once and is sterilized at the time of production, it need not be made of material which is heat resistant for repeated sterilizations by boiling, as is the case with conventional nipples. Accordingly, the nipple may be made of a relatively inexpensive elastomeric material and can be produced in varying sizes, hole openings and degrees of flexibility, appropriate to various states in infant development or growth.

As shown in FIGS. 1 and 3, when an annular ring 22 is provided as a means for holding the nurser, it is so formed as to have an outside diameter about $\frac{1}{8}$ to about $\frac{3}{4}$ inch greater than that of the cover 32. This provides convenient means for grasping the nurser firmly in the fingers when preparing the nurser for use. Two or more shoulders or ears **22*a*, as shown in FIG. 3, similarly project outwardly to the same extent, for the same purpose. It is also preferred to heat seal the sheet 12 to the opposed surface of the annular ring 22 in such a manner that the seal does not extend to the outside diameter of ring 22, as shown in FIG. 2, thereby providing a sort of overlying flange which can more readily be grasped, and without danger of puncturing the sheet 12** with the fingernails.

In order to prepare the nurser for use, it is necessary simply to remove one from the container 40 which is provided with a sterile, reusable lid (not shown), hold the unit in one hand by the holding means 22, **22*a* 22*b* or 22', unscrew the nipple means 24 with the cover 32 overlying it as a single unit, add water which may be previously sterilized by boiling, or tap water, screw the nipple means 24 and cover 32 back into place as a single unit, knead or shake the contents to dissolve the powdered formula, after which the cover 32 may be removed as by tab 34, 34*a***, automatically extending the nipple, and the nurser is then ready for use.

If nursing is interrupted for any reason, the cover 32 may be replaced, thus covering the nipple 24 and protecting it from outside contamination. The nurser can then be placed on almost any substantially flat or irregular surface without danger of falling off.

Markings for a desired fill of the container, or for determination of the amount consumed, may be provided as by imprinting on the container bag. Normally, the rated capacity of each bag will be obtained by filling the bag with liquid up to the base of the neck 20. The corolla-like or rosette configuration of the container bag, the biasing of the edges away from the nipple end and the positioning of powdered formula therein insure that it will fill to the desired capacity since water flows into all portions of the bag uniformly without creating large creases which might entrap air or powdered formula. Instead, a plurality of small creases is formed which are of generally pyramidal configurations. As shown in FIG. 2, when filled with water the container bag tends to approximate two euclidean constructions or shaped defined by generally triangular facets in a plurality of planes. This action is a function of the corolla-like configuration of the peripheral edges and results in a flexible, uniform structure, with the edges of the generally pyramidal shapes being rounded due to the resilient nature of the sheets 12 and 14 and the liquid therein.

It will be recognized that the temperature of the nurser after adding water can be readily determined both by the mother and by the infant simply by feeling the exterior surface of the container bag.

The diameter of the orifice 18 can range from about ½ to about 2½ inches, depending upon the capacity of the container bag. A relatively small opening is preferred since an unduly large opening tends to distort the shape which the bag assumes when filled with liquid.

The invention therefore provides a sterile, single-use, completely self-contained nurser, which may contain a measured amount of formula, admirably suited for home or hospital use, which can be easily and conveniently filled with liquid, which is lightweight, vertically and horizontally compact, easily handled, soft and flexible, and which will not roll off most surfaces.

Modifications may be made without departing from the spirit and scope of the invention. For example, while it has been indicated that heat sealing is preferred throughout, it would be possible to use a suitable adhesive. Moreover, elements which have been indicated to be integral could be made in a plurality of parts for ease of manufacture and secured together by conventional means. Further, it is within the scope of the invention to provide the nurser in sterile condition with other powdered infant diet materials such as various juices, cereals, and the like, or even empty for any desired feeding purpose.

We claim:

1. A disposable infant nurser comprising a pliable container bag formed of first and second superposed sheets of resilient, liquid-impermeable film material secured together along their mating peripheral edges, said edges having a corolla-like configuration of alternating inward and outward scallops; an orifice positioned centrally of said first sheet; a relatively rigid, upstanding circular neck extending outwardly from said orifice and secured to said first sheet circumferentially of said orifice, said neck including means for holding said nurser projecting radially outwardly adjacent the base of said neck; apertured nipple means releasably secured to said neck; and a removable cover overlying said nipple means and holding it in retracted position substantially within the confines of said neck.

2. The nurser claimed in claim 1, including a measured amount of dry, particulate infant formula distributed within said container bag between the peripheral edges thereof and said neck, and occupying the same height as said cover, nipple means and neck assembly, said neck area being devoid of formula to permit ready entry of liquid and uniform mixing.

3. The nurser claimed in claim 1 or 2, wherein the height thereof ranges from about one quarter to about one inch.

4. The nurser claimed in claim 1, wherein said peripheral edges are heat sealed to form a resilient margin defining said corolla-like configuration in such manner that said edges bias away from said nipple means and said bias persists when said bag is filled with liquid.

5. The nurser claimed in claim 1, wherein said corolla-like configuration of said peripheral edges causes said bag to approximate two euclidean constructions when filled with liquid.

6. The nurser claimed in claim 5, wherein said constructions form a series of radially disposed generally pyramidal shapes having apices directed outwardly.

7. The nurser claimed in claim 1, wherein said means projecting radially outwardly is an annular, substantially flat ring integral with said neck having an outside diameter about one eighth to about three quarters inch greater than that of said cover.

8. The nurser claimed in claim 1, wherein said means projecting radially outwardly is a first annular, substantially flat ring overlying said first sheet and having an outside diameter about one eighth to about three quarters inch greater than that of said cover, and a second annular, substantially flat ring integral with said neck underlying said sheet, said first ring, said sheet and said second ring being secured together.

9. The nurser claimed in claim 1, wherein said means projecting radially outwardly is a tab of dimensions suitable to be grasped in the fingers of a user.

10. The nurser claimed in claim 1, wherein said means projecting radially outwardly is at least two appropriately disposed shoulders.

11. The nurser claimed in claim 1, wherein said neck is externally threaded, and wherein said nipple means has mating internal threads.

12. The nurser claimed in claim 1, wherein said first and second sheets are each of about ½ to about 3 mil thickness and are formed of heat sealable polymeric films.

13. The nurser claimed in claim 1, wherein said corolla-like configuration comprises from 3 to 16 curvilinear, alternating inward and outward convolutions.

14. In a disposable infant nurser comprising a nipple assembly, a cover overlying said assembly, a pliable container bag having a nipple receiving orifice, and means for securing said nipple assembly to said container bag, the improvement comprising said container bag being formed of two superposed sheets of resilient, liquid-impermeable plastic material secured together along their mating peripheral edges, said edges having a corolla-like configuration of from 3 to 16 alternating inward and outward scallops, whereby said bag approximates a plurality of generally pyramidal radially disposed shapes having apices directed outwardly, when filled with liquid.

15. The improvement claimed in claim 14, including a relatively rigid, upstanding circular neck extending outwardly from said orifice and secured to said container bag circumferentially of said orifice, said neck having an integral annular, substantially flat ring overlying said orifice and extending radially outwardly therefrom, the outside diameter of said ring being about one eighth to about three quarters inch greater than the diameter of said cover.

16. The improvement claimed in claim 14 or 15, wherein said peripheral edges are heat sealed to form a resilient margin outlining said corolla-like configuration, in such manner that said edges bias away from said nipple assembly and said bias persists when said bag is filled with liquid.

17. In a disposable infant nurser comprising a nipple assembly, a cover overlying said assembly, a pliable container bag having a nipple receiving orifice, and means for securing said nipple assembly to said container bag, the improvement comprising means for holding said nurser projecting radially outwardly adjacent the base of said nipple assembly a distance of from about one eighth to about three quarters inch greater than the diameter of said cover.

18. The improvement claimed in claim 17, wherein said holding means comprises an annular substantially flat ring overlying said container bag and having an outside diameter about one eighth to about three quarters inch greater than that of said cover.

19. The improvement claimed in claim 17, wherein said container bag is formed of first and second superposed sheets of resilient, liquid impermeable film material secured together along their mating peripheral edges, said nipple receiving orifice being in said first sheet, and wherein said holding means comprise a first annular, substantially flat ring overlying said first sheet and having an outside diameter about one eighth to about three quarters inch greater than that of said cover, and a second annular, substantially flat ring underlying said first sheet, said first ring, said first sheet and said second ring being secured together.

20. The improvement claimed in claim 17, wherein said holding means comprises at least two appropriately disposed shoulders.

21. The improvement claimed in claim 17, wherein said holding means comprises a tab overlying said container bag of dimensions suitable to be grasped in the fingers of a user.

22. A disposable infant nurser comprising a pliable container bag formed of first and second superposed sheets of resilient, liquid-impermeable polymeric films secured together along their mating peripheral edges, said edges having a corolla-like configuration of alternating inward and outward scallops; an orifice positioned centrally of said first sheet; a relatively rigid, upstanding circular neck extending outwardly from said orifice and secured to said first sheet circumferentially of said orifice; and means for holding said nurser extending radially outwardly adjacent the base of said neck.

* * * * *